US010149524B2

(12) United States Patent
Churro Monteiro

(10) Patent No.: US 10,149,524 B2
(45) Date of Patent: Dec. 11, 2018

(54) LUNCH BAG FOR MEALS WITH SUPPORT FOR AN ENTERTAINMENT GADGET

(71) Applicant: António Manuel Churro Monteiro, Guarda (PT)

(72) Inventor: António Manuel Churro Monteiro, Guarda (PT)

(73) Assignee: António Manuel Churro Monteiro, Guarda (PT)

( * ) Notice: Subject to any disclaimer, the term of this patent is extended or adjusted under 35 U.S.C. 154(b) by 0 days.

(21) Appl. No.: 15/033,826

(22) PCT Filed: Oct. 31, 2014

(86) PCT No.: PCT/PT2014/050002
§ 371 (c)(1),
(2) Date: May 2, 2016

(87) PCT Pub. No.: WO2015/065216
PCT Pub. Date: May 7, 2015

(65) Prior Publication Data

US 2016/0278494 A1 Sep. 29, 2016

(30) Foreign Application Priority Data

Oct. 31, 2013 (PT) ..... 10969

(51) Int. Cl.
*A45C 11/20* (2006.01)
*A45F 3/46* (2006.01)
(Continued)

(52) U.S. Cl.
CPC ..... *A45C 11/20* (2013.01); *A45C 11/00* (2013.01); *A45C 13/10* (2013.01); *A45C 13/26* (2013.01);
(Continued)

(58) Field of Classification Search
CPC ..... A45C 11/20; A45C 11/00; A45C 13/10; A45C 13/26; A45C 15/00; A45C 2011/002; A45C 2011/003; A45F 3/46
(Continued)

(56) References Cited

U.S. PATENT DOCUMENTS 2,333,410 A * 11/1943 Busch ..... A45C 11/20 16/114.1
5,595,302 A * 1/1997 Maydwell ..... A45C 3/02 190/109
(Continued)

FOREIGN PATENT DOCUMENTS

CN 201 349 648 Y 11/2009
DE 10 2005 047 245 A1 10/2005
WO WO 2008/019017 A2 2/2008

*Primary Examiner* — Rafael Ortiz
(74) *Attorney, Agent, or Firm* — Leason Ellis LLP

(57) ABSTRACT

The present invention refers to a lunch bag which has integrated within it the dishes, cutlery and cup for meals, and which is equipped with a support for an entertainment gadget, such as a tablet, a smartphone or other. This equipment is especially suitable for children who need some entertainment during meals and is also indicated in cases of displacement, it makes it possible to have all the necessary accessories for a child's meal in one single space. It may be used as a tray for a child's meal, or simply as a means of protecting the entertainment gadget. The bag is composed of the top which includes the fastening system for the entertainment gadget and base, screen protection, compartment for dishes, compartment for cutlery, dishes, cutlery, cup, storage compartment for cup, compartment for cup when in use and holes for the carrying belt/strap.

11 Claims, 12 Drawing Sheets

(51) Int. Cl.

| | |
|---|---|
| ***A45C 11/00*** | (2006.01) |
| ***A45C 15/00*** | (2006.01) |
| ***A45C 13/10*** | (2006.01) |
| ***A45C 13/26*** | (2006.01) |

(52) U.S. Cl.
CPC ..... *A45C 15/00* (2013.01); *A45F 3/46* (2013.01); *A45C 2011/002* (2013.01); *A45C 2011/003* (2013.01)

(58) Field of Classification Search
USPC ..... 206/541–545, 547–550; 99/646 C; 220/592.02, 592.03, 592.16, 495.03
See application file for complete search history.

(56) References Cited

U.S. PATENT DOCUMENTS

| | | | | |
|---|---|---|---|---|
| 6,305,547 | B1 | 10/2001 | Curran | |
| 2002/0179482 | A1 | 12/2002 | Castaneda | |
| 2004/0016673 | A1* | 1/2004 | Kovich ..... | A45C 11/20 206/542 |
| 2004/0144783 | A1* | 7/2004 | Anderson ..... | A45C 11/20 220/23.87 |
| 2012/0031805 | A1* | 2/2012 | Stolarczyk ..... | A47J 39/006 206/541 |

* cited by examiner

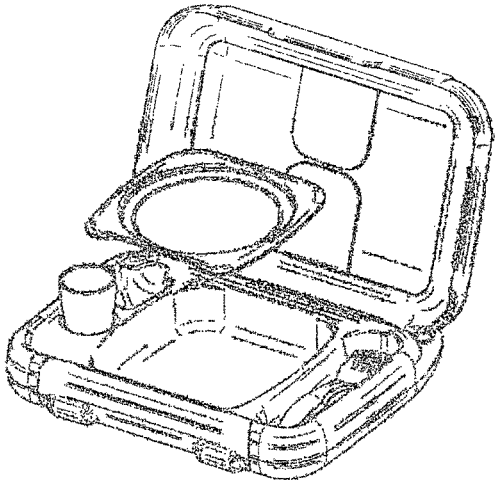
Fig. 12a
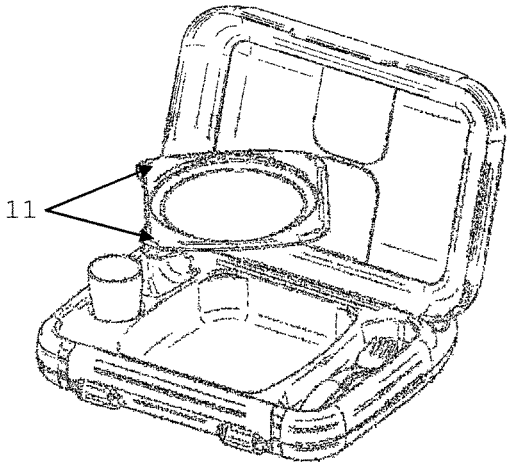
Fig. 12b
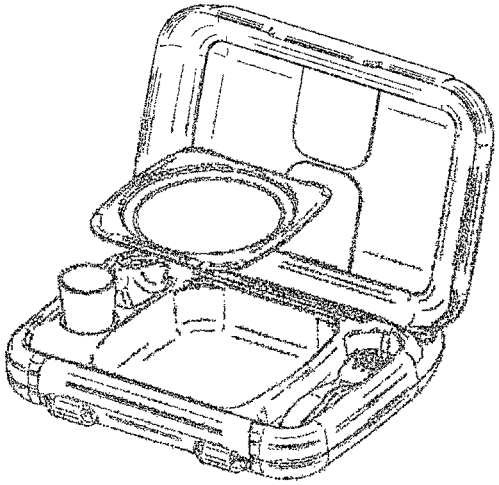
Fig. 12c
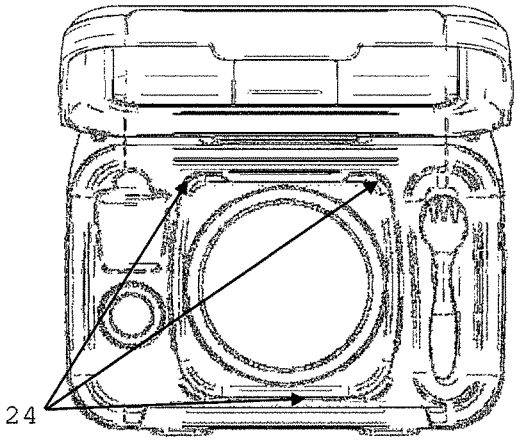
Fig. 12d
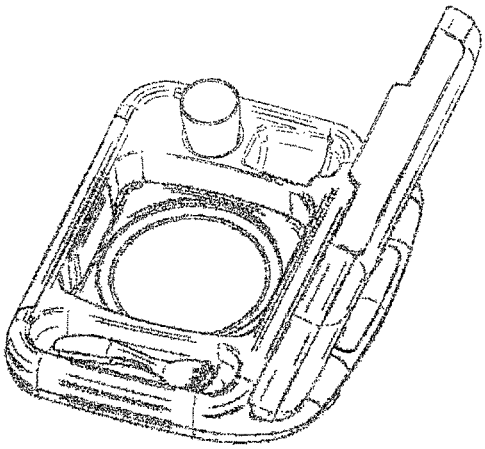
Fig. 12e
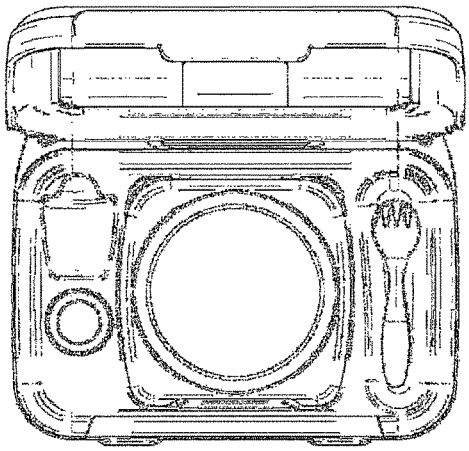
Fig. 12f
Fig. 12

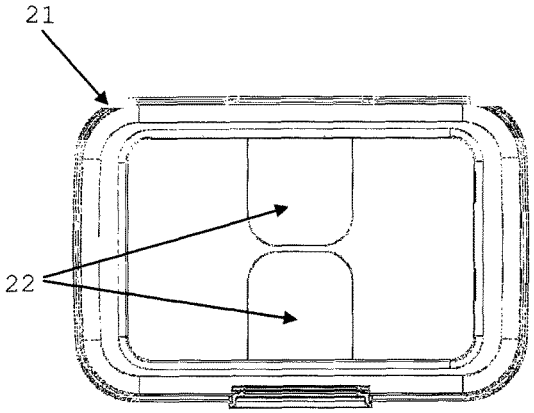
Fig. 15a
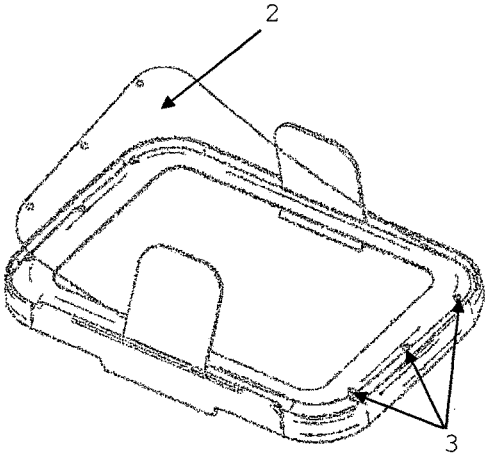
Fig. 15b
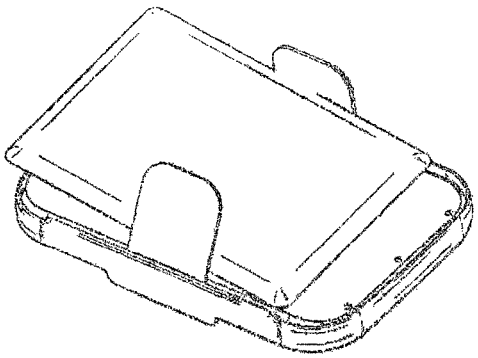
Fig. 15c
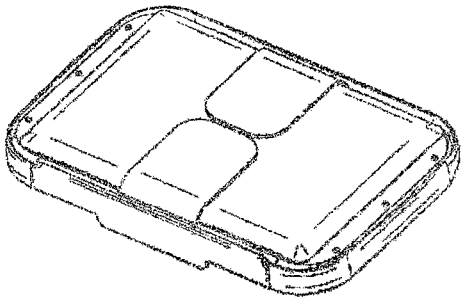
Fig. 15d
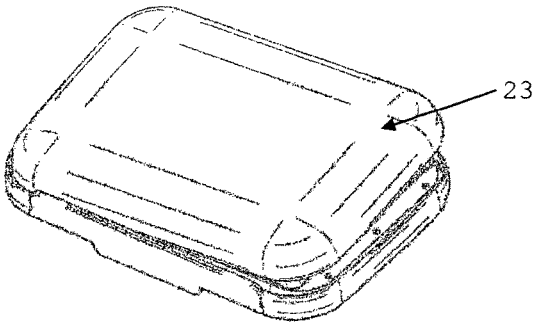
Fig. 15e
Fig. 15

LUNCH BAG FOR MEALS WITH SUPPORT FOR AN ENTERTAINMENT GADGET

CROSS-REFERENCE TO RELATED APPLICATIONS

This application is a U.S. National Stage Application under 35 U.S.C. § 371 of International Patent Application No. PCT/PT2014/050002, filed Oct. 31, 2014 which claims priority to Portugal Application No. 10969, filed Oct. 31, 2013, which are hereby incorporated by reference in their respective entireties.

FIELD OF THE INVENTION

The present invention refers to a lunch bag which has integrated within it the dishes, cutlery and cup for a meals, and which is equipped with a support for an entertainment gadget, such as a tablet, a smartphone or other.

It may be used as a tray for a child's meal, or simply as a means of protecting the entertainment gadget.

This equipment is especially suitable for children who need some entertainment during meals and is also suitable for travelling, as it makes it possible to have all the necessary accessories for a child's meal in one single space.

BACKGROUND OF THE INVENTION

There are well known various types of bags for the purpose of transporting meals and/or accessories for meals, especially for picnics. In most cases concerning bags geared for the transport of meals, the main concern is to ensure the thermal insulation so that the temperature is maintained as long as possible. Picnic bags are designed to allow the transport of all necessary accessories for a family to enjoy a picnic.

There are no documents referring to a lunch bag for meals with support for an entertainment gadget. The only document found was KR20080090358, which relates to a box with an integrated multimedia monitor. However, this product does not resemble in any way the item presented here.

Advantages of the Invention

The main advantage of the invention is to provide a device that solves the issue where a child requires entertainment in order to eat their food. Hence in a single space are included the necessary accessories for a meal (dishes, cutlery and cup) and the means of entertainment which may also serve as a tray or as a protective means for the entertainment gadget.

It also has the advantage that, in case of travelling, all the necessary meal accessories are gathered in one place. Given the existence of a system for insulation between the chamber with the accessories for the meal and entertainment gadget, the cleaning of eating utensils can be carried out later.

BRIEF DESCRIPTION OF THE DRAWINGS

These and other features can be readily understood by the accompanying drawings, which should be considered as examples and not restrictive in any way the scope of the invention. The drawings are for illustrative purposes, therefore the measurements of some of the elements may be exaggerated and not drawn to scale. The absolute dimensions and the relative dimensions do not correspond to real life size production of the invention.

FIG. 12 shows a detail of a second embodiment of the docking system and method for loading/unloading the dishes.

FIG. 15 shows a third embodiment of the locking system of the entertainment gadget.

Figure 1:
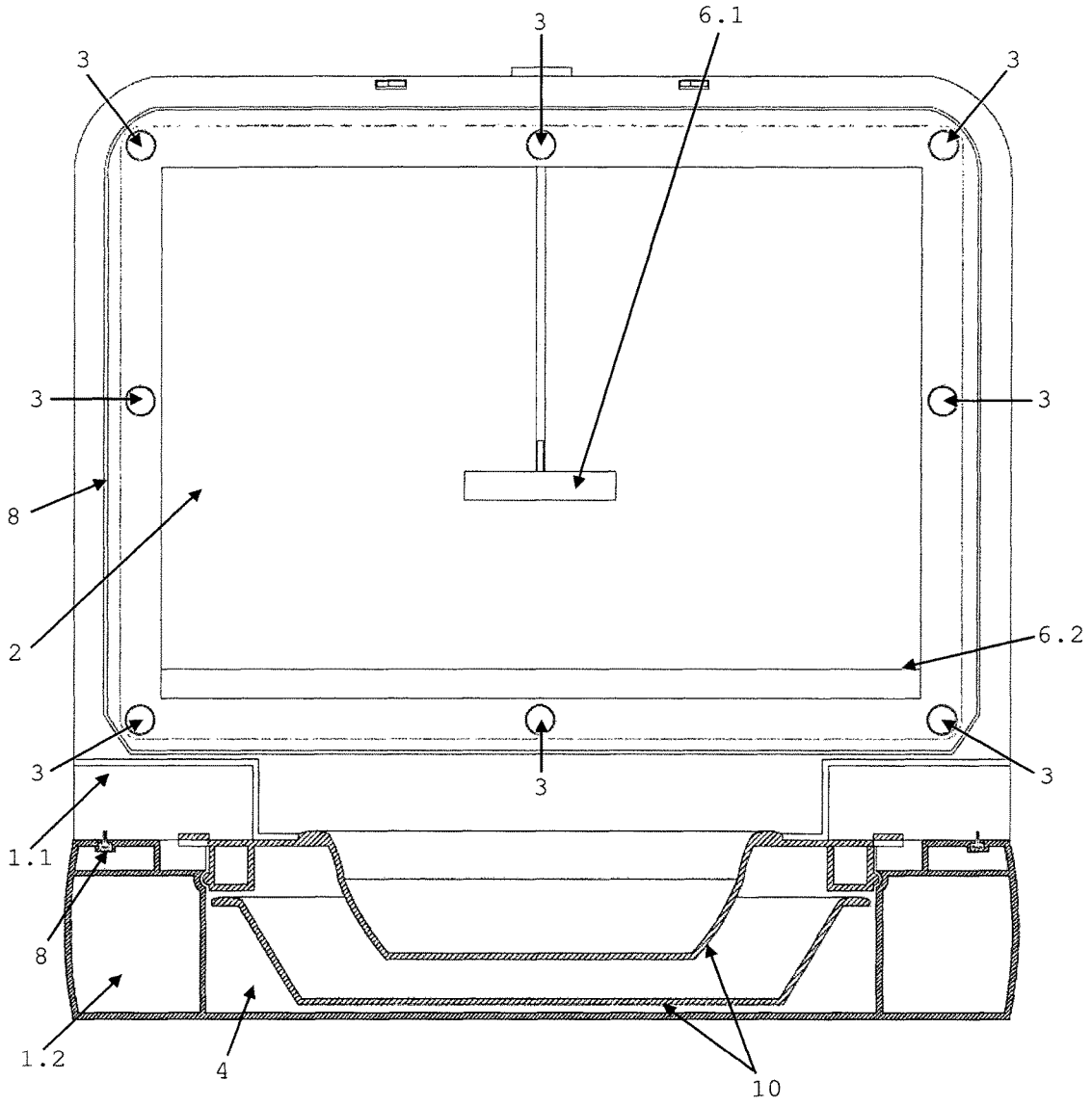
FIGS. 1, 2 and 3 show a front vertical section of the bag open, with three alternative embodiments.
Figure 2:
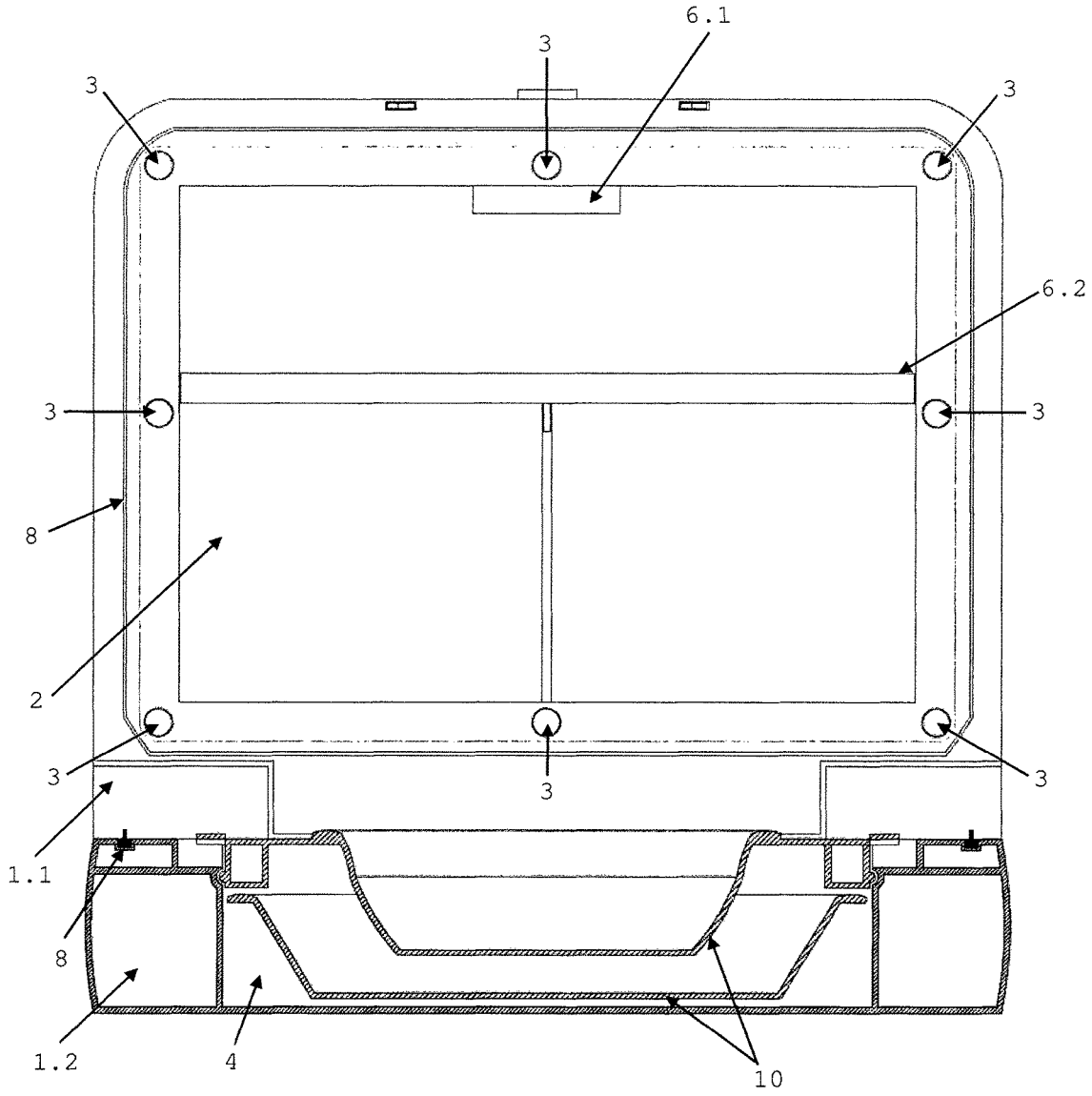
Figure 3:
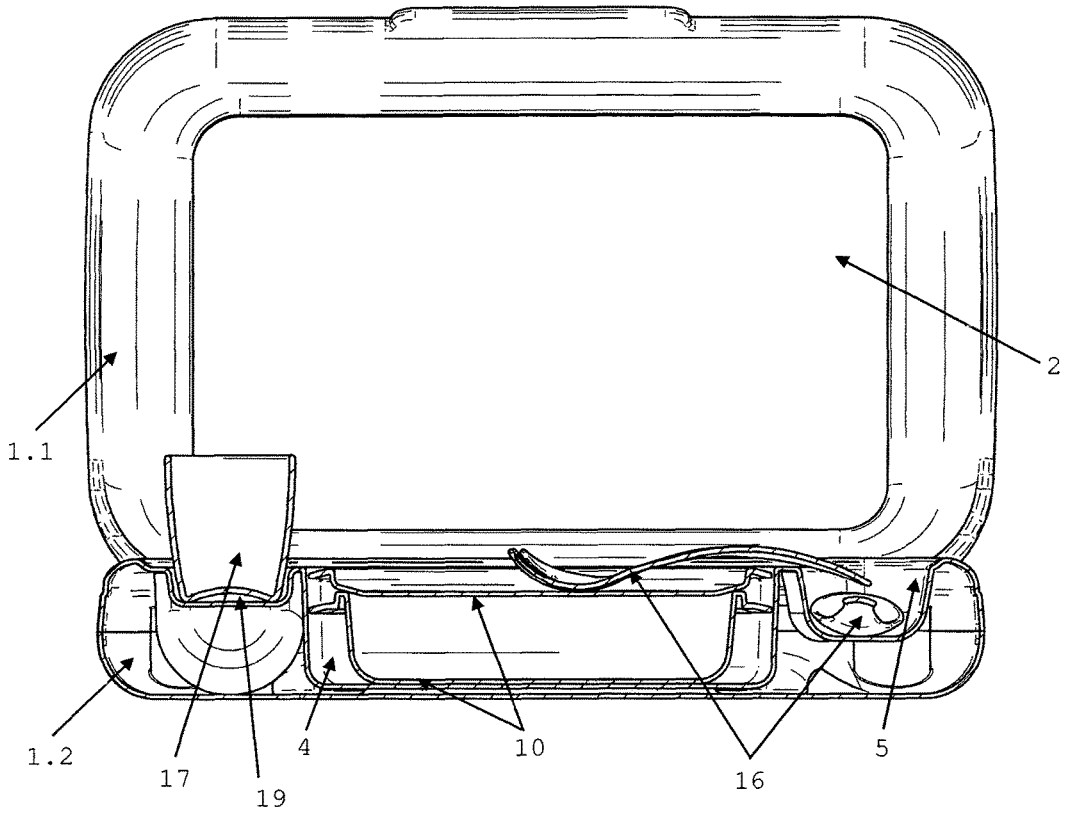
Figure 4:
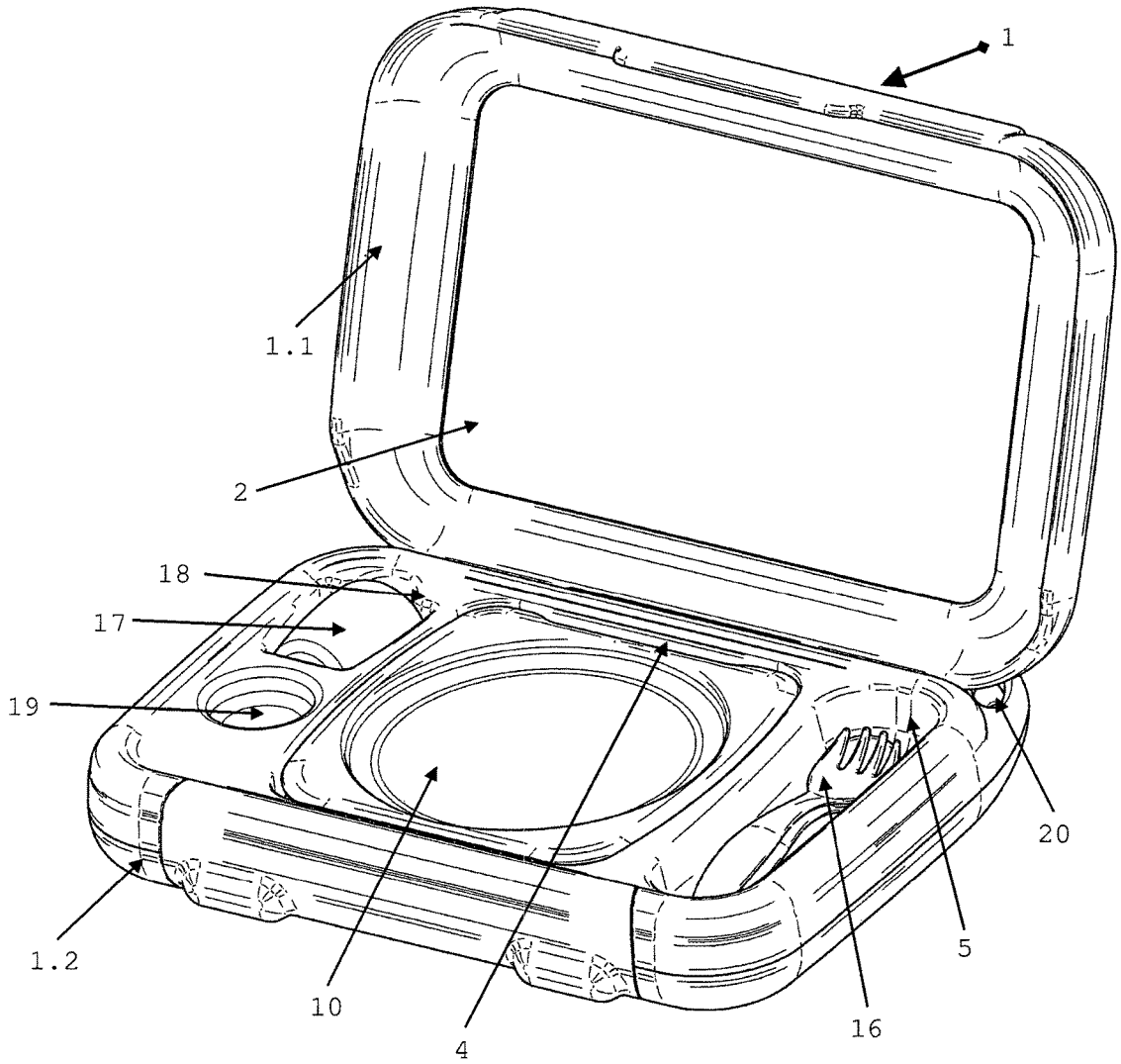
FIG. 4 shows a perspective view of the bag open, with an alternative embodiment.
Figure 5:
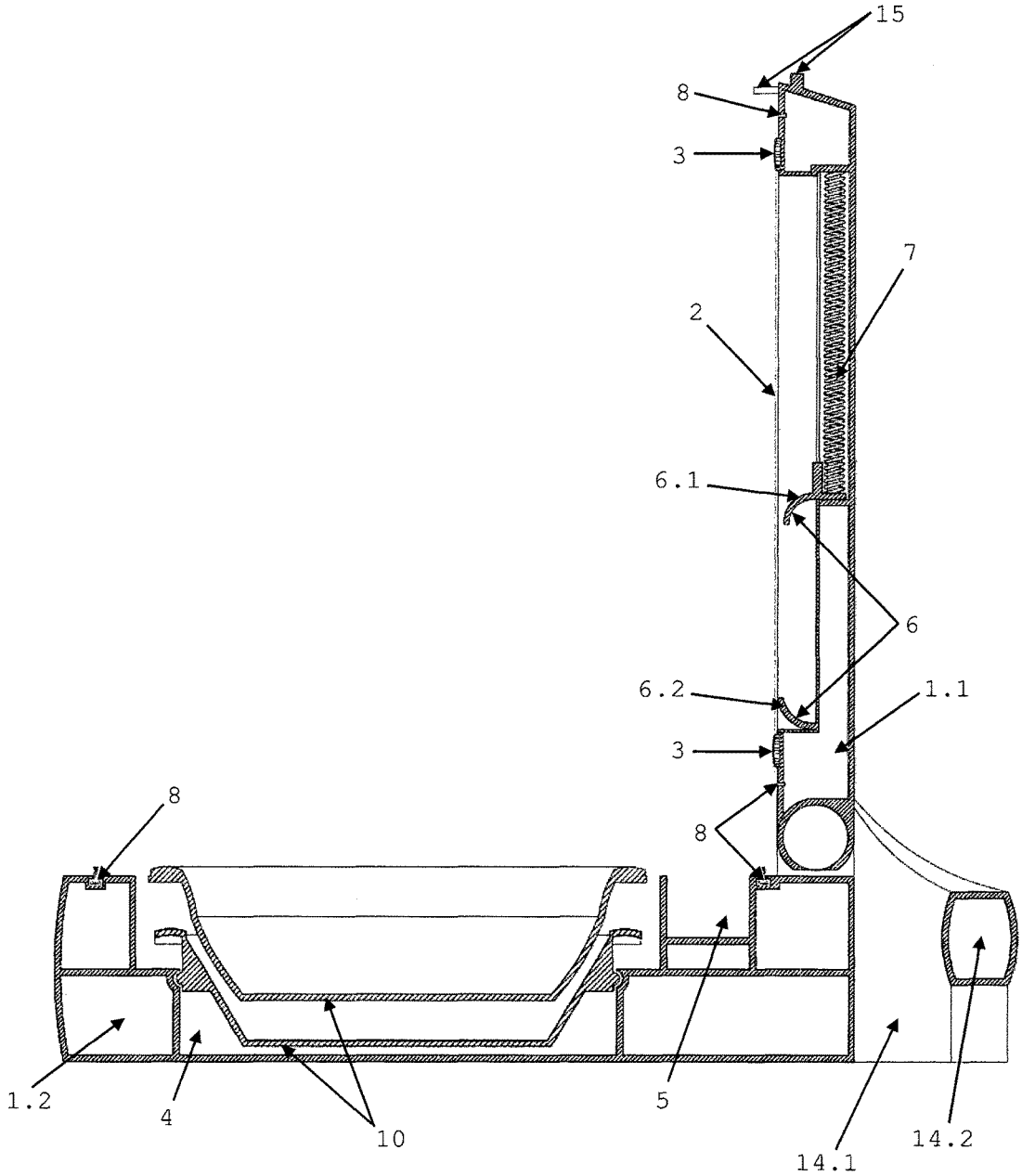
FIGS. 5 and 6 shows a side vertical section of the bag open, with two alternative embodiments.
Figure 6:
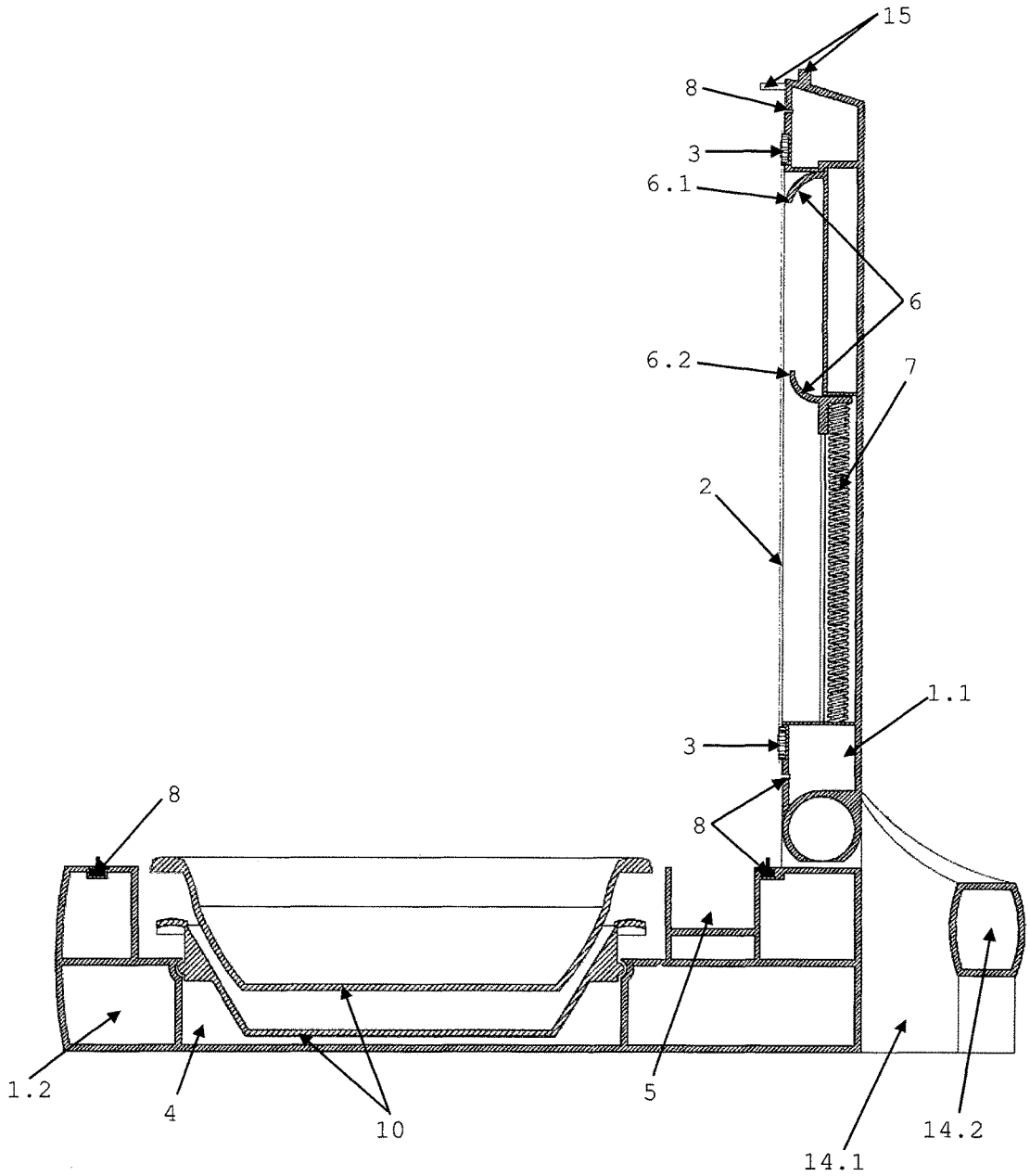

From the Figures it is visible to identify the various components and accessories: top (1.1) and base (1.2) of the bag (1), screen (2) protection, fittings (3) for the screen (2), compartment for dishes (4), compartment for cutlery (5), fittings (6) for entertainment gadget upper (6.1) and lower (6.2), spring (7) to hold the fittings, hermetic system for sealing the bag (8), dishes (10) upper (10.1) and lower (10.2), tabs (11), protuberance (12), concavity (13), ends of the handle (14.1) middle of handle (14.2), closing system (15), cutlery (16), cup (17), storage compartment for cup (18), compartment for cup when in use (19), holes (20) for the carrying belt/strap, frame (21) which integrates the protective tabs (22), frame cover (23) and protrusions (24).

DETAILED DESCRIPTION OF THE INVENTION

The present invention relates to a lunch bag for meals in which are embedded dishes, cutlery and cup for meals, and is equipped with a means of support for entertainment gadgets and may also serve as a tray when a child is having a meal, or simply as a protective element for the entertainment gadget.

The terms "right side" and "left side", "front part" and "back part", "upper" and "lower" are used in the description for descriptive purposes and not necessarily to describe relative positions. It is noted that the terms are used interchangeably in appropriate circumstances and that the embodiments of the invention described in this document are capable of working in different orientations other than the ones described or illustrated in this document. In this way, the descriptions used "substantially horizontal", "substantially vertical", "substantially hemicilindrical" are mentioned as preferred ways to produce the invention, although it can operate with other formats.

The terms "right side" and "left side", "front part" and "back part", "upper" and "lower" are the locations perceived by an observer located in front of the bag (1) when it is open.

Regarding the fixation of the entertainment system it is refers to any system which ensures that the entertainment gadget remains fixed in situ. The different embodiments listed below are by no means limitative to the scope of the invention.

Regarding the securing system of the dishes it refers to any system that ensures that the dishes remain fixed in situ. The embodiments mentioned below are by no means limitative to the scope of the invention.

The bag (1) has a handle plated on the back, which its ends (14.1) are incorporated in the base (1.2) of the bag (1) follow the bottom of the same, functioning as counterweight, causing the bag (1) to remain balanced and in a stable position when it is open. The central part (14.2) of the handle is narrower so as to allow a child's hand to grasp it and thus carry the bag (1). It also has holes (20) that allow the placement of a carrying belt/strap.

A closing system (15) placed on front of the bag ensures that the bag does not open when it is being transported.

The bag is made of any material suitable for this purpose, namely a polymeric base material.

According to FIGS. 1 to 8 the bag (1) has in its base (1.2), i.e. the part which is normally substantially horizontal when open, a compartment for dishes (4) with dishes (10), a compartment for cutlery (5) with cutlery (16), a compartment for cup when in use (19), a storage compartment for cup (18) and cup (17).

Figure 13:
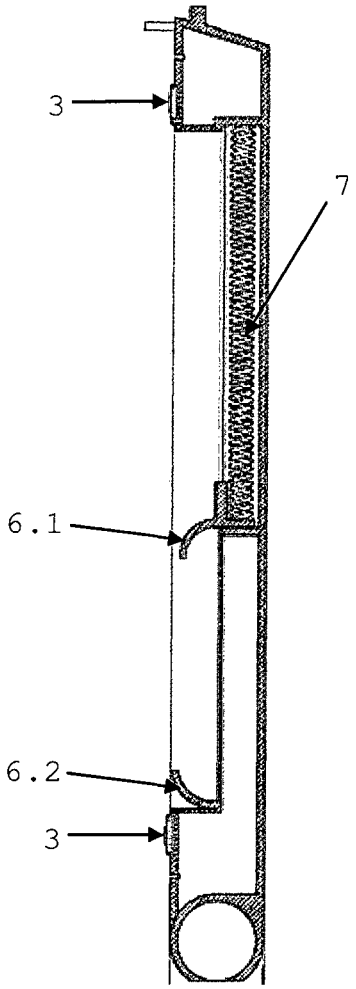
FIG. 13 shows a first embodiment of the locking system for the entertainment gadget.
Figure 14:
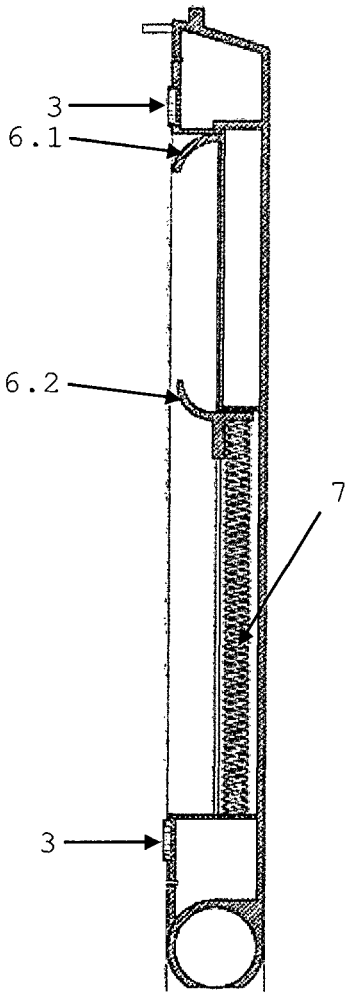
FIG. 14 shows a second embodiment of the locking system of the entertainment gadget.

As shown in FIGS. 13 to 15, the top (1.1) of the bag (1), i.e. the part which is normally substantially vertical when opened, has a fastening system for housing an entertainment gadget of any dimension. A screen (2) placed in front of the entertainment gadget enables its protection, preventing it from being damaged if splashed by the food. This screen (2) is fixed to the top (1.1) of the bag (1) by a fastening system with non-permanent engaging elements permitting its removal for cleaning or replacement in the case of irreparable damage. It also serves to isolate the entertainment gadget from the remaining elements of the bag when the bag (1) is closed.

As shown in FIGS. 13 and 14 in two alternative embodiments, the fastening system for the entertainment gadget is composed of fittings (6) upper (6.1) and lower (6.2) and the spring (7) to hold the fittings. The device is activated by pulling the upper fitting (6.1) upwards, thus allowing the entertainment gadget to be put in place. When the entertainment gadget is placed in the desired position, simply release the upper fitting (6.1), through the force exerted by the spring (7) will be remain in situ, preventing it to dislodge from its position.

According to FIG. 15, a third alternative embodiment, the fastening system of the entertainment gadget is constituted by the frame (21) in which are integrated the protective tabs (22) at diametrically opposed positions, and through the frame cover (23). According to FIG. 15*a*, the protective tabs (22) which in their initial position are in a substantially parallel position to the frame (21) are as shown in FIG. 15*b*, placed in a substantially perpendicular position to the frame (21), thus allowing the space immediately above the screen (2) to be accessible. Still according to FIG. 15*b* upon fixing the screen (2) to the frame (21) through the fittings (3) placed on the rear edge of the frame cover (23), according to FIG. 15*c* the entertainment gadget is placed in the existing space between the screen (2) and protective tabs (22). Once the entertainment gadget is properly placed, as shown in FIG. 15*d* the protective tabs (22) take up their initial position, i.e. substantially parallel to the frame (21) so as to prevent the entertainment gadget from dislodging. Finally, as shown in FIG. 15*e* of the frame cover (23) is fitted in the frame (21).

Figure 9:
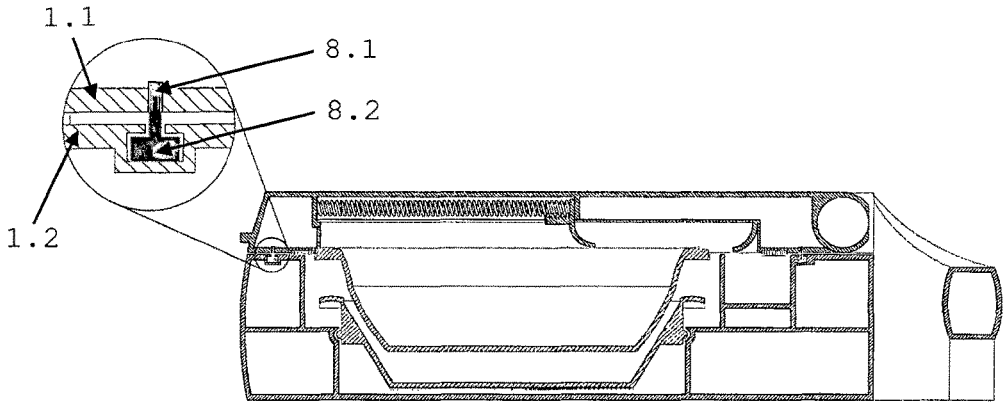
FIG. 9 shows a detailed first embodiment of the hermetic system for sealing the bag (8), constituted by the groove (8.1) for fitting isolating element (8.2).

In a first embodiment, the hermetic system for sealing the bag (1) as shown in FIG. 9, is constituted by a groove (8.1) on the top (1.1) of the bag (1), where the isolating element is housed which is (8.2) fitted onto the base (1.2) of the bag (1) and thus guarantees its tightness when it is closed.

Figure 10:
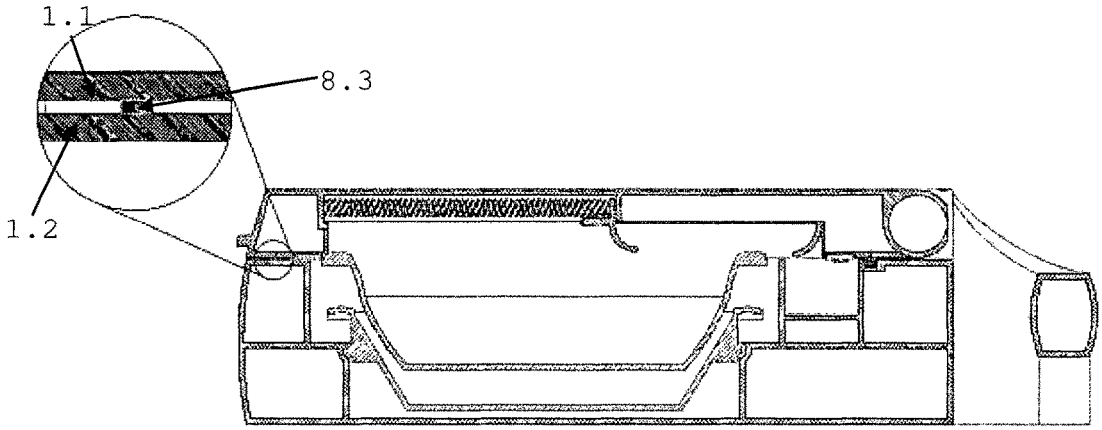
FIG. 10 shows a detail of a second embodiment of the hermetic system for sealing the bag (8).

In a second embodiment, the hermetic system for sealing the bag, as shown in FIG. 10, comprises a projection (8.3) produced with a polymer material with stretching properties, compressible, which can be placed on top (1.1) or base (1.2) of the bag (1), which when the bag is closed, it remains in contact with another part of the bag (1), thus guaranteeing its tightness.

A screen (2) isolates both parts of the bag from each other bag (1), the top (1.1) and the base (1.2), when it is closed, allowing the dishes (10), the cutlery (16) and the cup (17) to be confined within their own space, thus avoiding mess inside the bag (1) if they are soiled or have been left with food remains.

Figure 7:
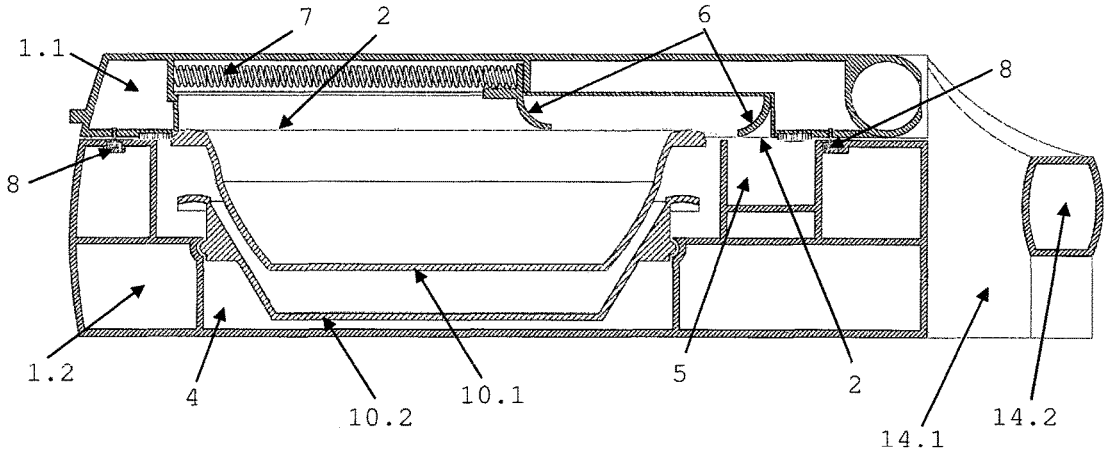
FIGS. 7 and 8 shows a sideways vertical section of the bag closed, with two alternative embodiments.
Figure 8:
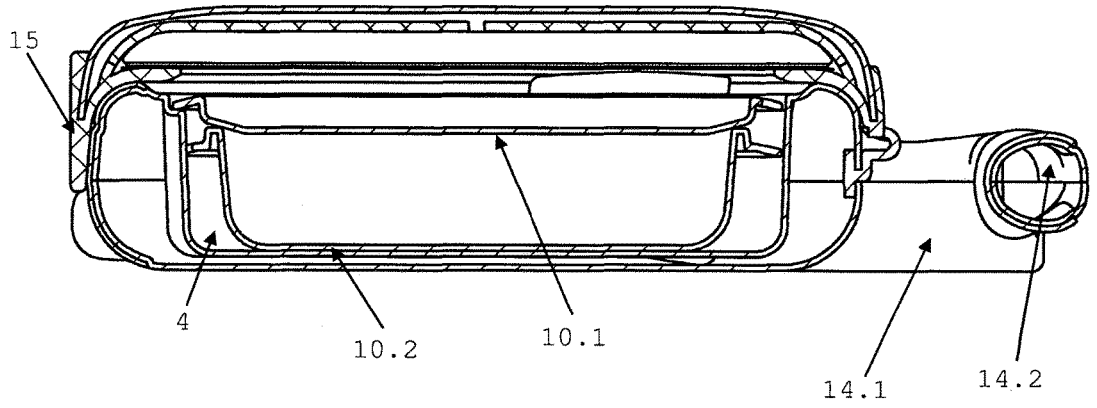

In an embodiment of the apparatus of the invention according to FIG. 7, as the edge of the upper dishes (10.1) is slightly elevated relative to the upper plane of the base (1.2) of the bag (1) and the screen (2) is in the same lower plane of the top (1.1) of the bag (1), when closing the bag (1) the screen (2) puts pressure on the dishes (10.1) thus isolating it.

The dishes (10) have an immobilization system within the compartment for dishes (4) in the base (1.2) of the bag (1) which guarantees its total immobility under any circumstance.

Figure 11:
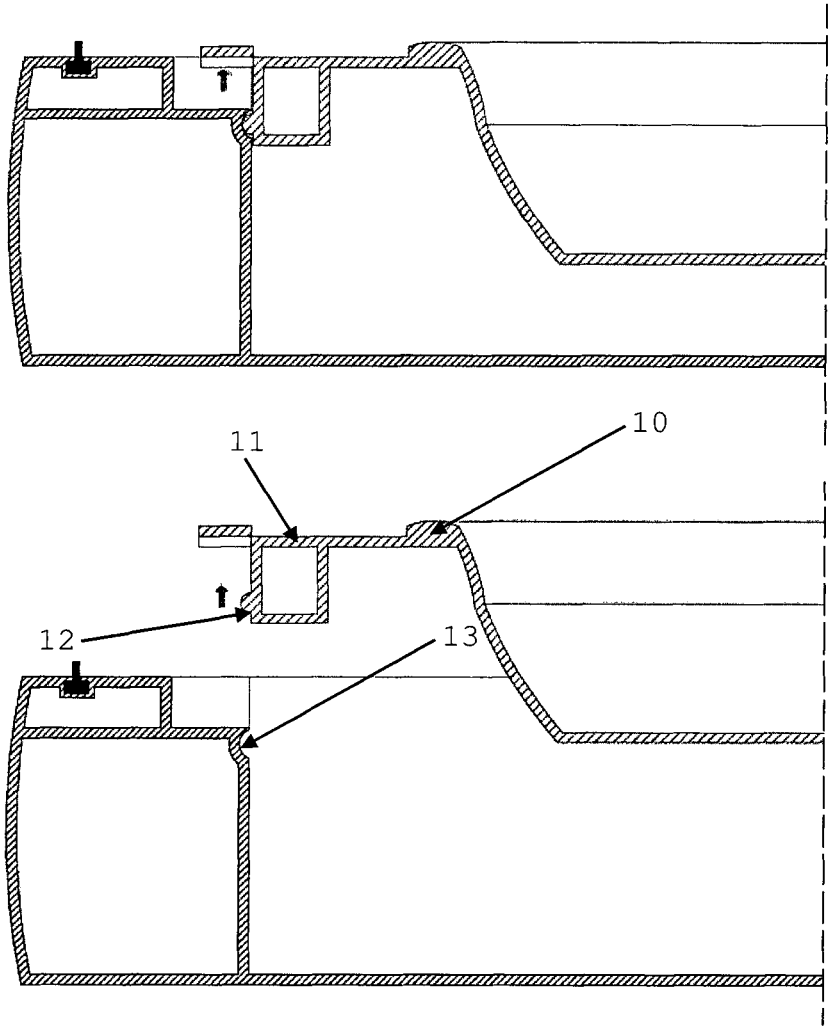
FIG. 11 shows a detail of a first embodiment of the docking system and method for loading/unloading the dishes.

In a first embodiment, according to FIG. 11, this locking system is characterized by the existence of tabs (11) substantially horizontal placed on both sides of the dishes (10), under which there is a protuberance (12) with a substantially hemicylindrical format which fits into the concavity (13) existing in the compartment for dishes (4) in the base (1.2) of the bag (1). To lock/unlock the dishes (10) it is sufficient to apply light pressure to the tabs (11), in an ascending direction to unlock and in a descending direction to lock. According to FIG. 3, the upper dish (10.1) has tabs (11) placed on the right side and the left side, and according to FIG. 5, the lower dish (10.2) has tabs (11) placed in the front and at the back.

In a second embodiment, according to FIG. 12, this system is characterized by having three protrusions (24) substantially horizontal placed in the compartment for dishes (4) in the base (1.2) of the bag (1) and two tabs (11) existing on the dishes (10) placed in non-diametrically opposite corners, which allow the immobilization of the dishes (10). To lock/unlock the dishes (10) it is sufficient to apply light pressure to the tabs (11), in an ascending direction to unlock and in a descending direction to lock. According to FIG. 12*a*, upon detaching the dish (10.1) according to FIGS. 12*b* and 12*c*, rotating it 180 will re-insert it into the compartment for dishes (4), and in accordance with FIGS. 12*d* and 12*f*, serving the protrusions (24) as a support for the dishes (10), thus allowing its use in a higher position.

The invention claimed is:

1. A lunch bag for meals with support for an entertainment gadget, comprising at least one dish; cutlery; and a cup, wherein the bag includes an interior between top and base portions, and wherein the top comprises:

a screen protection element;

a fixing system comprising fittings for receiving and securing the screen to the top of the bag;

a fastening system configured to secure one or more entertainment gadgets; and a closure; and wherein the base comprises:

a handle having a center and opposing ends;

a first compartment sized to receive at least one dish;

a second compartment sized to receive cutlery;

a third compartment sized to hold a cup while in use;

a storage compartment sized to receive the cup; and an immobilization system for immobilizing the at least one dish, wherein the bag further comprises a seal configured to hermetically seal the top and base portions of the bag system for sealing the bag, and wherein the fastening system comprises a frame cover and a frame having integrated protective tabs in diametrically opposed positions.

2. The lunch bag for meals with support for an entertainment gadget according to claim 1, wherein the bag comprises a polymeric material.

3. The lunch bag for meals with support for an entertainment gadget according to claim 1, wherein the fixing system comprises non-permanent locking elements configured to enable removal of the screen.

4. The lunch bag for meals with support for an entertainment gadget according to claim 1, wherein the screen is positioned within the bag to isolate the top and the base portions of the bag when the bag is in a closed position.

5. The lunch bag for meals with support for an entertainment gadget according to claim 1, wherein the handle is placed on a back of the bag, the ends extending from the base portion.

6. The lunch bag for meals with support for an entertainment gadget according to claim 1, wherein the fastening system comprises upper and lower fittings and a spring to hold the fittings.

7. The lunch bag for meals with support for an entertainment gadget according to claim 1, wherein the immobilization system of the dishes comprises tabs substantially horizontal placed on both sides of the dishes, and a protuberance having a shape that fits a concavity of the compartment for dishes in the base of the bag.

8. The lunch bag for meals with support for an entertainment gadget according to claim 1, wherein the immobilization system of the dishes comprises of three protrusions substantially horizontal placed in the compartment for dishes, and further comprises two tabs placed in non-diametrically opposite corners.

9. The lunch bag for meals with support for an entertainment gadget according to claim 1, wherein the seal comprises a groove on the top of the bag where isolating element is fitted placed on the base of the bag.

10. The lunch bag for meals with support for an entertainment gadget according to claim 1, wherein the seal comprises a stretchable and compressible projection made from a polymer material, the seal being located on the top or the base of the bag.

11. The lunch bag for meals with support for an entertainment gadget according to claim 1, wherein the fittings are spaced from one another, leaving room for placement of the entertainment gadget.

* * * * *